US010259253B2

(12) United States Patent
Schönenberger et al.

(10) Patent No.: US 10,259,253 B2
(45) Date of Patent: Apr. 16, 2019

(54) FLEXIBLE BAND

(71) Applicant: Gemalto AG, Aarau (CH)

(72) Inventors: Ivo Schönenberger, Zurich (CH); Christian Sailer, Safenwil (CH)

(73) Assignee: GEMALTO AG, Aarau (CH)

( * ) Notice: Subject to any disclaimer, the term of this patent is extended or adjusted under 35 U.S.C. 154(b) by 0 days.

(21) Appl. No.: 15/533,806

(22) PCT Filed: Dec. 8, 2014

(86) PCT No.: PCT/EP2014/076892
§ 371 (c)(1),
(2) Date: Jun. 7, 2017

(87) PCT Pub. No.: WO2016/091277
PCT Pub. Date: Jun. 16, 2016

(65) Prior Publication Data

US 2017/0326901 A1 Nov. 16, 2017

(51) Int. Cl.

| | |
|---|---|
| ***B42D 15/00*** | (2006.01) |
| ***B42D 25/355*** | (2014.01) |
| ***B42D 1/00*** | (2006.01) |
| ***B42D 13/00*** | (2006.01) |
| ***B42D 25/29*** | (2014.01) |
| ***B42D 25/24*** | (2014.01) |

(Continued)

(52) U.S. Cl.
CPC ..... *B42D 25/355* (2014.10); *B42D 1/002* (2013.01); *B42D 13/00* (2013.01); *B42D 25/24* (2014.10); *B42D 25/29* (2014.10); *B42D 25/309* (2014.10); *B42D 25/337* (2014.10); *B42D 25/382* (2014.10); *B42D 25/387* (2014.10)

(58) Field of Classification Search
CPC ..... B42D 25/00; B42D 25/24; B42D 25/355
See application file for complete search history.

(56) References Cited

U.S. PATENT DOCUMENTS 4,942,077 A * 7/1990 Wendt ..... A47K 10/02 162/111
5,465,301 A * 11/1995 Jotcham ..... D21H 21/42 283/72

(Continued)

FOREIGN PATENT DOCUMENTS

DE 202009013388 U1 2/2010
DE 102009010800 B3 7/2010

(Continued)

OTHER PUBLICATIONS

Text Info, Theory and calculation of cover factor, Sep. 27, 2013, https://textInfo.wordpress.com/2011/10/28/theory-and-calculation-of-cover-factor/.*

*Primary Examiner* — Shin H Kim
(74) *Attorney, Agent, or Firm* — The Webb Law Firm

(57) ABSTRACT

A flexible band configured to be connected to a data page and to a booklet, wherein the flexible band extends along a main direction and includes an upper side and a lower side as well as a plurality of apertures, wherein the flexible band includes at least one security element, wherein the security element is provided by at least one security print pattern; or the security element is provided by at least one security thread; or the security element is provided by at least one security print pattern in combination with at least one security thread.

32 Claims, 3 Drawing Sheets

(51) Int. Cl.

| | |
|---|---|
| ***B42D 25/309*** | (2014.01) |
| ***B42D 25/337*** | (2014.01) |
| ***B42D 25/382*** | (2014.01) |
| ***B42D 25/387*** | (2014.01) |

(56) References Cited

U.S. PATENT DOCUMENTS 6,135,503 A * 10/2000 Lob ..... B42D 25/00 281/21.1
7,122,248 B2 * 10/2006 Tam ..... D01D 5/253 428/397
7,357,986 B2 * 4/2008 Tam ..... D01D 5/253 428/195.1
8,336,915 B2 * 12/2012 Christen ..... B42D 1/002 281/27
8,585,093 B2 * 11/2013 Christen ..... B42D 25/355 281/27
2002/0025418 A1 * 2/2002 Ishibashi ..... B41M 3/14 428/211.1
2002/0160188 A1 * 10/2002 Tam ..... D01D 5/253 428/397
2003/0194578 A1 * 10/2003 Tam ..... D01D 5/24 428/690
2004/0209052 A1 * 10/2004 Tam ..... D01D 5/253 428/195.1
2007/0210074 A1 * 9/2007 Maurer ..... B60N 2/5685 219/549
2011/0091677 A1 * 4/2011 Egli ..... B42D 13/00 428/43
2012/0043879 A1 * 2/2012 Chabrecek ..... H01L 51/442 313/503
2014/0265295 A1 * 9/2014 Rhyner ..... B42C 9/0043 281/38
2016/0355045 A1 * 12/2016 Ivester ..... B42D 25/40
2017/0197452 A1 * 7/2017 Philippe ..... B42D 25/364

FOREIGN PATENT DOCUMENTS

EP 1502765 A1 2/2005
EP 2433809 A1 3/2012

* cited by examiner

FLEXIBLE BAND

CROSS-REFEFENCE TO RELATED APPLICATION

This application is the U.S. national phase of International Application No. PCT/EP2014/076892 filed Dec. 8, 2014, the disclosure or which is hereby incorporated in its entirety by reference.

TECHNICAL FIELD

Disclosed embodiment relate to a flexible band for connecting a data page with a booklet, and to a data page with flexible band for a booklet, such as a passport.

PRIOR ART

EP 1 502 765 teaches a data page having a textile band as a hinge in order to connect the data page to a booklet such as a passport. Although very good results have been achieved with the data page according to EP 1 502 765 the need arises to enhance the security of such documents against misuse and unlawful manipulation like exchanging the data page.

SUMMARY OF THE INVENTION

An object of the present invention is to provide a flexible band for connecting a data page with a booklet, wherein said flexible band enhances the security of the connection between a data page and the flexible band as well as between the data page and the booklet to which the data page is connected via the flexible band.

A flexible band is configured to be connected to a data page and to a booklet, wherein the flexible band extends along a main direction and comprises an upper side and a lower side as well as a plurality of apertures. The flexible band comprises at least one security element. The security element is in a first embodiment provided by means of at least one security print pattern, in particular by means of at least one security print pattern only. In a second embodiment said security element is provided by means of at least one security print pattern in combination with at least one security thread. The security element is in a third embodiment provided by means of at least one security thread, in particular by means of at least one security thread only.

Said security elements which are provided as integral parts of said flexible band enhance the security of the flexible band. In fact due to the arrangement of said security element the protection against forgery will be enhanced and it becomes almost impossible to detach a data page by manipulation of the flexible band and eventually re-attach to a different booklet without showing traces of such a fraudulent manipulation.

Preferably the security print pattern according to the first and second embodiment is provided by means of at least one print color that is printed on the upper side and/or on the lower side of said flexible band. The print color can be a security ink or any other suitable print color such as but not limited to UV fluorescent inks, UV bi-fluorescent inks, or infrared transparent and infrared absorbing inks.

In connection with the data page the flexible band extends partly into the data page. In the region of the flexible band within the data page said security print pattern can be recognized in case the data page is transparent or translucent and said security print pattern cannot be recognized in case the data page is opaque. In the region that does not extend into the data page the security print pattern can be recognized without any limitation.

Preferably said print color extends at least partly into the flexible band as seen from said upper side and/or said lower side. This is in particular the case if said flexible band is provided as textile or as structure with mesh openings.

Preferably the print color is characterized by a specific visual appearance and/or by a specific fluorescence behavior and/or by a specific absorbance behavior. Therefore the print color has different appearances and/or behavior when being illuminated with different wave lengths of an illumination source. In other words the reflection characteristics and/or fluorescence characteristics and/or absorbance characteristics of the print color is different under different light wave lengths of an illumination source.

In a first variant the visual appearance of the print color under normal ambient illumination is different from the appearance under illumination in the ultraviolet region. Hence the color appearance changes for example from red or white under normal ambient illumination to blue under illumination in the ultraviolet region. The print color in this case is fluorescent.

In a second variant the fluorescence behavior refers to excitation with wave lengths in the ultraviolet domain. Hence the appearance or color appearance changes for example from invisible or white under normal ambient illumination to blue under illumination in the ultraviolet region. The print color in this case is fluorescent.

In a third variant the absorbance behavior refers to the absorbance of wave lengths in the infrared domain. Therefore, the print color can show dedicated behavior when examined in the infrared (IR) domain such being visible (IR-absorbing) or not visible (IR-transparent). To summarize: A security print pattern is not visible when viewed under normal ambient illumination but becomes visible when being inspected in the infrared domain or vice-versa.

In other words with regards to all variants as mentioned above: The print color shows a dedicated visual appearance and/or a dedicated fluorescent characteristic and/or a dedicated absorption characteristic under ambient illumination and/or under ultraviolet illumination and/or under examination in the infrared region.

The following table shows possible examples of color combinations:

| | Appearance under normal ambient illumination | Appearance under Ultraviolet illumination | Appearance under Infrared illumination |
|---|---|---|---|
| Example 1 | not visible | Red, blue, yellow & others | Not visible |
| Example 2 | Red, blue, yellow & others | not visible | Visible |
| Example 3 | Red, blue, yellow & others | Red, blue, yellow & others | not visible |

As mentioned the table above shows only possible examples and is not to be considered as limitation with regard to the colors chosen. In fact several other combinations are also feasible.

Preferably the shape or appearance of the security print pattern is chosen from the group of: drawings, or pictograms, or illustrations, or guilloche lines or alphanumeric codes or emblems, in particular national emblems, or coat of arms or personalized information, such as a name, a photograph or a serial number. Alternatively the shape or appearance is a combination of drawings, and/or pictograms, and/or illustrations, and/or guilloche lines and/or alphanumeric codes and/or emblems, in particular national emblems, and/or coat of arms and/or personalized information.

Preferably the flexible band according to all of the embodiments is a textile band having weft threads and warp threads, and wherein said apertures are provided between said weft threads and said warp threads. The textile band provided in other words a mesh-like structure.

Preferably in the first embodiment several security print patterns are arranged. Said security print patterns are preferably arranged at a regular or irregular spacing with regard to each other.

In the second and third embodiment said security thread replaces at least one of said weft threads and/or at least one of said warp threads. This means that instead of a weft or a warp thread said security thread will be weaved into the textile structure. The security thread then is an integral part of the textile. Alternatively it may also be possible to weave said security thread between two neighboring weft threads or between two neighboring warp threads, whereas the two weft threads or the two warp threads have the same distance. This means that the aperture or mesh will be smaller in the region of the security thread.

Preferably the security thread is made out of the same material as said weft threads or said warp threads.

Preferably said security thread is a monofilament having one single filament. Said one single filament has one single specific visual appearance and/or one single specific fluorescence behavior and/or one single specific absorbance behavior. Alternatively one single filament has different specific visual appearances and/or different specific fluorescence behaviors and/or different specific absorbance behaviors, wherein said visual appearance and/or fluorescence behavior and/or specific absorbance behavior changes regularly or irregularly spaced along the extension direction of the single filaments.

Alternatively to said monofilament said security thread is a multifilament with at least two single filaments that are twisted against each other or that are interwoven with each other. The filaments have preferably the same specific visual appearance and/or the same specific fluorescence behavior and/or the same specific absorbance behavior. Alternatively the filaments have different specific visual appearances and/or different specific fluorescence behaviors and/or different specific absorbance behaviors, wherein said visual appearance and/or fluorescence behavior and/or specific absorbance behavior is the same along the extension direction of the single filament or wherein said visual appearance and/or fluorescence behavior and/or specific absorbance behavior changes regularly or irregularly spaced along the extension direction of the single filaments.

It is also possible to use monofilament security threads and multifilament threads in one single flexible band. This enhances the protection against forgery even more.

Due to the specific visual appearances and/or the specific fluorescence behavior and/or the specific absorbance behavior said filament in the monofilament or multifilament appears in different colors or in different appearances when being illuminated with different wave lengths of an illumination source.

According to a first variant the visual appearance of said filament as such under normal ambient illumination is different from the visual appearance under illumination in the ultraviolet region. Hence the visual appearance of said filament changes for example from red under normal ambient illumination to blue under illumination in the ultraviolet region. The filament in this case is fluorescent.

According to a second variant the fluorescence behavior refers to excitation with wave lengths in the ultraviolet domain. Hence the appearance or color of the filament changes for example from not visible or white under normal ambient illumination to blue under illumination in the ultraviolet region. The filament shows dedicated behavior when examined in the ultraviolet domain. The print color in this case is fluorescent.

According to a third variant the absorbance behavior refers to the absorbance of wave lengths in the infrared domain. Therefore, the filament can show dedicated behavior when examined in the infrared (IR) domain such being visible (IR-absorbing) or not visible (IR-transparent).

Preferably the diameter of said security thread is the same as the diameter of said weft threads or said warp threads. The flexible band has then a uniform thickness. Alternatively the diameter of said security thread is larger or smaller than the diameter of said weft threads or said warp threads.

In a preferred arrangement at least two of said security threads are arranged adjacent and parallel to each other and form a first group of neighboring security threads, said security threads have the same specific visual appearances and/or the same specific fluorescence behavior and/or the same specific absorbance behavior. Additionally an additional group of adjacent security threads or a single security thread is arranged at a distance from said first group of neighboring security threads. With this regard it is possible to arrange groups of security threads having different widths. The arrangement of additional groups is also possible.

The term adjacent is to be understood that between two neighboring security threads there is no further weft or warp thread extending parallel to the security thread. The security threads are arranged next to each other.

In a further preferred arrangement a first group of at least one security thread and a second group with the same number of security threads as the first group or plus or minus at least one additional security thread is arranged a distance from the first group. Additionally an optional third group with the same number of security threads as the second group or plus or minus at least one additional security thread is arranged at a distance from the first and the second group. In each group the security thread within one group are arranged adjacent to each other.

In the second embodiment in which at least one security print pattern and at least one security thread is arranged said security print pattern preferably overlaps said at least one security thread.

In the second embodiment which is the combination between the security print pattern and the security thread several security print patterns and several security threads are arranged. Said security print patterns are placed at a regular or irregular spacing with regard to the security print pattern. Said security threads are placed at a regular or irregular spacing with regard to the security threads. Even more preferably the spacing between the print patterns and the spacing between security thread is regular or irregular.

Preferably in the third embodiment several security threads are arranged at a regular or irregular spacing with regard to each other.

Preferably said security element according to all of the embodiments is oriented perpendicular to the main direction of the flexible band and/or angularly tilted to the main direction of the flexible band and/or in line with the main direction of the flexible band. Further preferably the orientation is a combination of said transverse direction, said angularly tilted direction and/or said in line direction.

Preferably the flexible band is made out of plastics chosen from the group of polycondensations plastics, such as polyesters (preferably polyethylene terephtalate), polyamides, polyimides, aramides, polyamidimides or polycarbonates or combinations thereof, or from the group of polymerisation plastics, such as polyacrylnitriles, polytetrafluorethylene, polyethylene, polypropylene or polyvinylchloride, or combinations thereof.

Preferably a data page arrangement comprising a flexible band according to the description above and a data page, wherein said flexible band protrudes with a protruding region from the data page and with a connection region into the data page, in which connection region the flexible band is in a substantially non-detachably manner connected to the data page.

Said flexible band forms an inner layer between at least two outer layers of said data page, such that the flexible band is bound into the data page by means of lamination, wherein at or in the apertures of the flexible band connection points are formed, which connect the flexible band substantially non-detachably to the data page. The flexible band is sandwiched between the outer layers of said data page.

Via the protruding region the data page can be connected to a booklet such as a passport. In particular the data page can be sewn in.

Preferably said security element, in particular said security print, said security thread or said combination of said security print and said security thread is arranged such that it extends from the protruding region into the connection region and vice-versa.

Preferably the flexible band is connected flatly to the data pages, in particular by means of lamination.

Preferably the orientation of the weft or warp threads is parallel to the edge of the data page. Alternatively the orientation of the weft or warp threads is angularly tilted to the edge of the data page.

Preferably the data page has two outer layers, which on the inside in each case have an area which connects these two layers to the flexible band. The flexible band is preferably in contact with said data page with its upper surface and its lower surface. Via the apertures as well as said upper and said lower side a firm connection between said flexible band and said data page can be achieved.

Preferably the flexible band connects two layers of the data page to each other. This means that the flexible band extends into a space between said layers or is in contact with the outer surfaces of said layer.

Preferably the data page is made out of polycarbonate.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Figure 1:
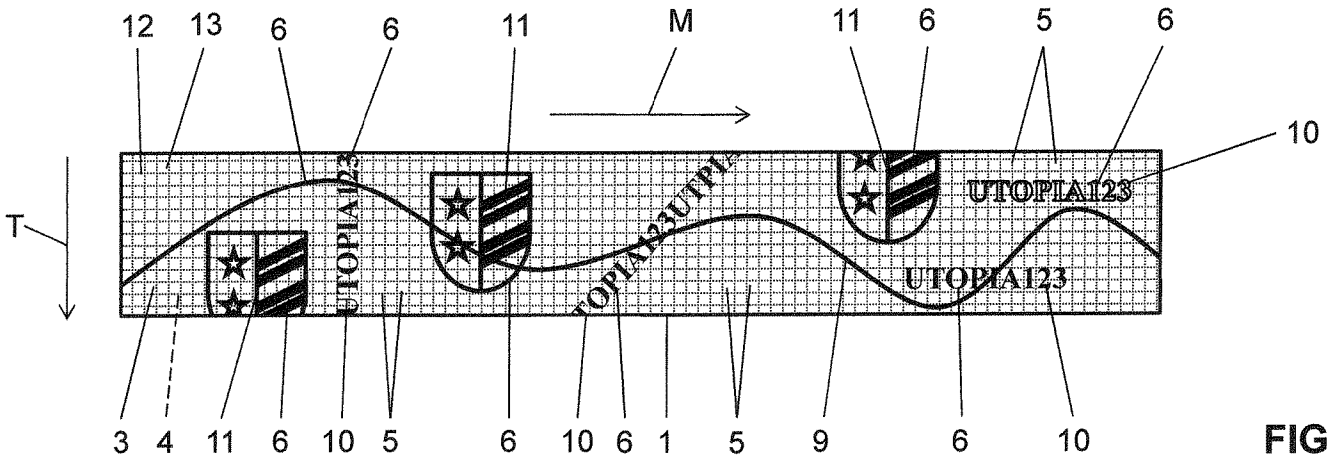
FIG. 1 shows a first embodiment of a flexible band according to the present invention.

FIG. 1 shows a first embodiment of a flexible band 1 configured to be connected to a data page and to booklet. The data page serves as holder for personal data and may include visible information as well as data stored on a chip. The booklet is preferably a passport.

The flexible band 1 serves as hinge element between the data page and the booklet. Neither the data page nor the booklet is shown in FIG. 1. The flexible band 1 extends along a main direction M and comprises an upper side 3 and a lower side 4. Furthermore a plurality of apertures 5 extend through the flexible band 1 from the upper side 3 to the lower side 4. The flexible band 1 comprises at least one security element 6.

In the first embodiment according to FIG. 1 the security element 6 is provided by means of at least one security print pattern 6. The security print pattern 6 is provided on the surface of the flexible band 1 and is thereby printed onto the upper side 3 or the lower side 4. Depending on the structure of the flexible band 1 the printing pattern 6 extends at least partly into the flexible band 1. The latter applies in particular to a mesh or a textile. This means that the security print 6 is not only arranged on the upper side 3 or the lower side 4 but it can also extend into the flexible band 1 from said upper side 3 and said lower side 4.

The security print pattern 6 is preferably a color print pattern. The color print pattern will be printed on the flexible band. Preferably the color print pattern has the following properties:

In a first variant the visual appearance of the print color is different under normal ambient illumination and under illumination in the ultraviolet region. Preferably said visual appearance of the print color is transparent or white or red or blue or green or yellow or a combination thereof under normal ambient illumination and under illumination in the ultraviolet region. Hence the color changes for example from red under normal ambient illumination to blue under illumination in the ultraviolet region.

In a second variant the fluorescence behavior refers to excitation with wave lengths in the ultraviolet domain. Hence the appearance or color changes for example from not visible or white under normal ambient illumination to blue under illumination in the ultraviolet region.

In a third variant the absorbance behavior refers to the absorbance of wave lengths in the infrared domain. Therefore, the print color can show dedicated behavior when examined in the infrared (IR) domain such being visible (IR-absorbing) or not visible (IR-transparent). To summarize: A security print pattern is not visible when viewed under normal ambient illumination but becomes visible when being inspected in the infrared domain or vice-versa.

Normal ambient illumination is to be understood as conventional illumination as it is usually present in a room or under sunlight.

The color of the security print pattern 6 that is provided with a print color is preferably white or red or blue or green or yellow. Hence, it is preferably that predetermined colors are present. Additionally it is also possible to provide a combination of the colors.

As it can be seen from FIG. 1 the shape or appearance of the security print pattern 6 can be chosen from a variety of groups. In the embodiment of FIG. 1 several first security print pattern 6 in the shape of a coat of arms 11 are present. Furthermore there are second security print patterns in the form of an alpha numeric code 10 and there are third security print patterns in the form of a guilloche line 9. National emblems are also possible.

The appearance of the alphanumeric code 10 can be different. Additionally it may also be possible that the security print pattern 6 may comprise personalized information such as a name or a photograph of the holder of the passport or a serial number of the document. This personalized information refers to the holder of the document or to the document and is to be printed for each single document. Hence, there is personalization not only of the data page but also on the flexible band 1 serving as a hinge between the data page and the booklet.

The various security print pattern 6 may overlap each other. In the present case the guilloche line 9 overlaps the alphanumeric code 10 and the coat of arms 11. Other overlapping security print patterns 6 are also possible.

Each security print pattern 6 can be arranged in a regular or irregular spacing with regard to a further security print pattern 6. With regard to the coat of arms one can clearly see that the coat of arms 11 are arranged in an irregular spacing with regard to the main direction M as well with regard to transversal direction T. The transversal direction T is transversal or perpendicular to the main direction M. The same applies to the alpha numeric codes 10. The guilloche line 9 extends as a wave-like line over the whole length of the flexible band 1 along the main direction M. Furthermore the guilloche line 9 has parts that are arranged angularly tilted with regard to the main direction M. Also the alphanumeric code 10 is angularly tilted with regard to the main direction M. As it can be seen in FIG. 1 it is preferable that the single elements of the security print pattern 6 are arranged such that they extend more or less over the full surface of the flexible band 1. This means that the security can be enhanced.

The flexible band 1 according to the first embodiment and also according to the other embodiments is preferably a textile band having weft threads 12 and warp threads 13. Apertures 5 are provided between weft threads 12 and warp threads 13.

It is preferable that according to the first embodiment only said at least one security print pattern is arranged as security element. There are no security threads.

Figure 2:
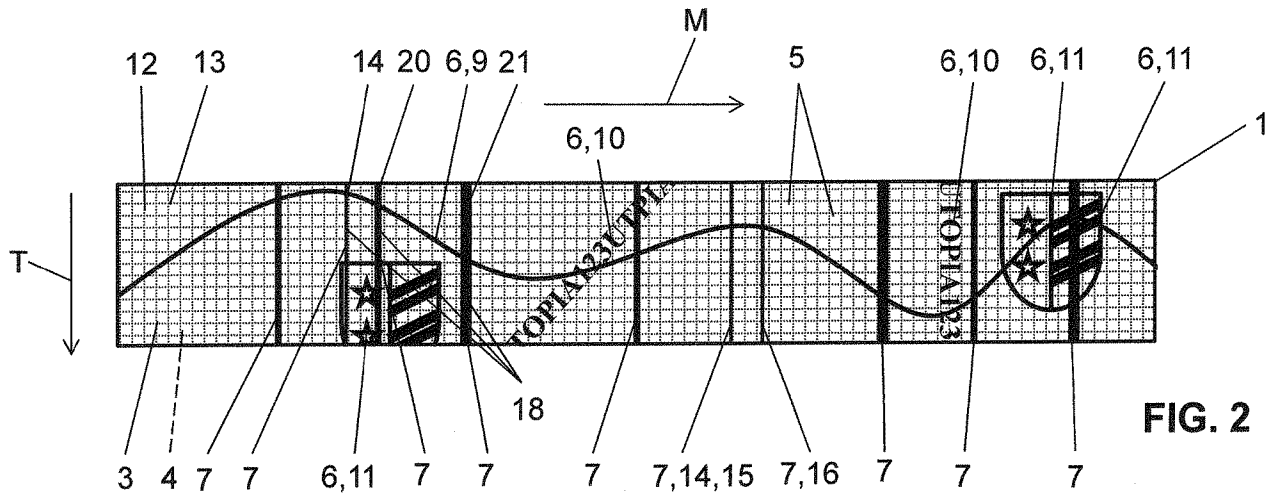
FIG. 2 shows a second embodiment of a flexible band according to the present invention.

FIG. 2 shows a second embodiment according to the present invention. Same features are designated with the same reference numeral. The security element in this embodiment is provided by means of the combination of at least one security print pattern 6 and of at least one security thread 7. With regard to the description of the security print pattern 6 reference is made to the description with regard to the first embodiment. This description is applicable mutatis mutandis with regard to the second embodiment according to FIG. 2. The flexible band 1 is, as outlined above, a textile band 1 having a weft thread 12 and a warp thread 13. The security thread 7 replaces at least one of said weft thread 12 and/or at least one said warp thread 13. This means that the security thread 7 becomes a part of the textile band 1 and has not only a security purpose but serves also as a normal thread of the textile. Alternatively a security thread 7 may also be squeezed in between two neighboring weft threads 12 or two neighboring warp thread 13.

As it can be seen in FIG. 2 it is preferable that some of the security threads 7 are positioned adjacent to each other. This means that the appearance of the security thread 7 becomes thicker. The inspection personnel therefore are provided with a security element that can be easily recognized. Further explanations with regard to the adjacent positioning of the security threads will be given below with regard to FIG. 3.

The security thread 7 that can be used in the second embodiment according to FIG. 2 can be monofilament 14 which has one single filament 15. Said one single filament 15 has one single specific visual appearance and/or one single specific fluorescence behavior and/or one single specific absorbance behavior. Alternatively said one single filament 15 can have different specific visual appearances and/or different specific fluorescence behaviors and/or different specific absorbance behaviors, wherein said visual appearance and/or fluorescence behavior and/or specific absorbance behavior changes regularly or irregularly spaced along the extension direction of the single filaments. This means that the visual appearances and/or fluorescence behavior and/or absorbance behavior of the monofilament 14 changes over its length. With regard to the appearance of the color it has to be mentioned that the color may be different when viewed at ambient illumination or under illumination in the ultraviolet region. With regard to the appearance and the behavior it has to be mentioned that the appearance may be different when viewed at ambient illumination or under examination in the infrared region.

Figure 4:
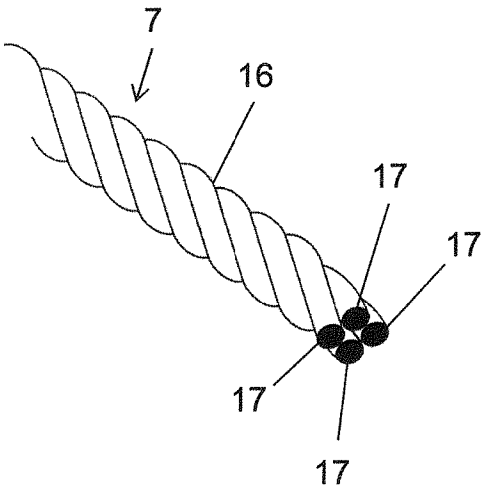
FIG. 4 an example of a multifilament security thread to be used in the second and third embodiment.

The security thread 7 can also be the multifilament 16. An example of the multifilament 16 is shown in FIG. 4. Such a multifilament has at least two single filaments 17 that are twisted against each other or that are interwoven with each other. In FIG. 4 four different single filaments 17 are twisted against each other. Generally speaking it is possible to provide the multifilament 16 with at least two single filaments. The number and the structure of the multifilament 16 can be in further versions different than as shown in FIG. 4.

The filaments 17 in said multifilament security thread 16 can have the same specific visual appearances and/or the same specific fluorescence behaviors and/or the same specific absorbance behaviors. This means for example that each of the filaments 17 has the same appearance in terms of color as the other filaments 17 in the same multifilament structure 16. In a further variant the filaments 17 may have different specific visual appearances and/or different specific fluorescence behaviors and/or different specific absorbance behaviors, wherein said visual appearance and fluorescence behavior and/or specific absorbance behavior are the same along the extension direction of the single filament 17. This means for example that some of the filaments 17 in this multifilament structure 16 have different colors from each other. Furthermore it is possible that each of the filaments 17 different specific visual appearances and/or different specific fluorescence behavior and/or different specific absorbance behavior, wherein said visual appearance and/or fluorescence behavior and/or specific absorbance behavior changes regularly or irregularly spaced along the extension direction of the single filaments (17). Hence the single filament can have a single appearance and/or behavior or its appearance and/or behavior can be variable in terms that it changes regularly or irregularly spaced along the extension direction of the filaments 17. This has the advantage that customized security threads can be provided and that a variety of colors can be used. As mentioned with the others colors used with regard to the security thread 7 the same applies to the colors used in the multifilament structure 16. Thereby the color may change its appearance when being viewed at normal ambient illumination or when being viewed at illumination in the ultraviolet region or in the infrared region.

The security thread 7, irrespective of whether it is a monofilament 14 or a multifilament 16, preferably has a diameter that is equal to the diameter of said weft thread 12 or said warp thread 13. This means that there is no haptic difference in the textile where the security thread 7 is interwoven. In an alternative version the diameter of said security thread 7 is larger or smaller than the diameter of said weft thread 12 or said warp thread 13. This can be used to provide a haptic appearance which can be recognized by the inspection personnel very easily.

Figure 3:
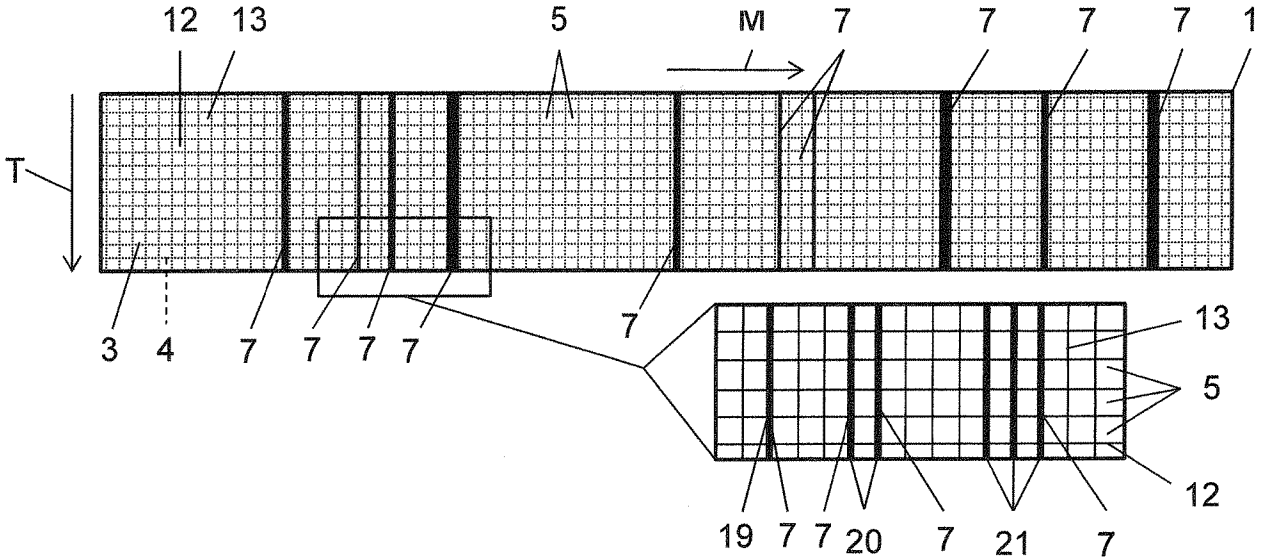
FIG. 3 a third embodiment of a flexible band according to the present invention with an explanatory section that is also applicable to the second embodiment.

FIG. 3 shows a detailed possible structure of a further arrangement of said security threads 7 that can be used in the second embodiment according to FIG. 2. There are several groups of security threads 7 arranged. A first group 19 comprises at least one security thread 7. Here the first group 19 comprises one single security thread 7. Furthermore a second group 20 of security threads 7 is arranged. The second group 20 comprises the same number of security threads 7 as the first group 19 plus at least one further security thread 7. In the present case the second group 20 comprises two security threads 7. The second group 20 is arranged at a distance with regard to the first group 19. Additionally a third group 21 of security threads 7 is arranged. The third group 21 comprises the same number of security threads 7 as the second group 20 plus at least one additional security thread 7. In this case exactly one additional security thread 7 is arranged. This means the third group 21 comprises three security threads 7 that are arranged adjacent to each other. The third group 21 is arranged at a distance from the second group 20. The distance between the third group 21 and the second group 20 is thereby larger than the distance between the first group and the second group. With regard to the security threads 7 in each group it is to be said that said security threads 7 are arranged adjacent to each other within one single group. Hence the definition of a group includes adjacent arranged security threads 7. The number of security threads 7 in each group as well as the number of groups and the distance between two neighboring groups may be variable.

The specific visual appearances and/or the specific fluorescence behavior and/or the specific absorbance behavior of the threads in one group can be different to each other. It is then possible to have a specific visual appearance or fluorescence behavior or absorbance behavior for each group. This means that every group is provided with the same visual appearance and/or fluorescence behavior and/or absorbance behavior of the other groups. Further it is possible to have a random visual appearance or fluorescence behavior or absorbance behavior for each group which leads to a random visual appearance or fluorescence behavior or absorbance behavior under the threads as well as under the groups.

The specific visual appearances and/or the specific fluorescence behavior and/or the specific absorbance behavior of the threads in one group can be identical to each other. For example: a first group can be provided with security threads having the same color and a second group can be provided with security threads having the same color. The color of the first group can be different or identical from the color of the second group.

It is also possible that the number of security threads becomes lower from one group to the other.

The distance between the security threads 7 or the group of security threads 19, 20, 21 can be, as seen along the main direction M regular or irregular. An irregular spacing is preferable as this enhances security. Furthermore it is also possible to vary the order of the groups which means that the first group may be followed by the third group and the third group may then be followed by the second group.

From FIG. 2 it becomes clear that in this second embodiment in which the security print pattern 6 and the security thread 7 are arranged the security print pattern 7 preferably overlaps at least one of the security threads 7. In the present case the guilloche line 9 extends over all of the security threads 7. Furthermore also the coat of arms 11 extends over some of the security threads 7.

It is preferable that the distance between the several security print patterns 6 is different with regard to the distance between said security threads 7. Furthermore also the distance between the single elements of the security print pattern 6 is different with regard to each other and the same applies to the security threads 7. This means that the security elements 6, 7 are arranged in a displaced manner. This enhances security as well.

In a further third embodiment, that is illustrated by means of FIG. 3 one can see that this third embodiment comprises security threads 7 as security element, but no print patterns. The security thread 7 can be arranged as it has been outlined with regard to FIG. 2 and FIG. 3 or FIG. 4 and FIG. 5 respectively. The description as mentioned above can be applied mutatis mutandis to this third embodiment.

Preferably the security elements 6, 7 according to all embodiments are oriented toward the transverse T to the main direction M of the flexible band 1. Alternatively the security elements 6, 7 can also be angularly tilted to the main direction of the flexible band 1. Additionally the security elements 6, 7 can also be in line with the main direction M of the flexible band 1. As it can be seen from the figures a mixture of these orientations is also possible.

The flexible band 1 according to all the three embodiments is preferably made out of plastic chosen from the group polycondensations plastics, such as polyesters (preferably polyethylene terephtalate), polyamides, polyimides, aramides, polyamidimides or combinations thereof; or polymerisation plastics, such as polyacrylnitriles, polytetrafluorethylene, polyethylene, polypropylene, polyvinylchloride or combinations thereof.

Figure 5:
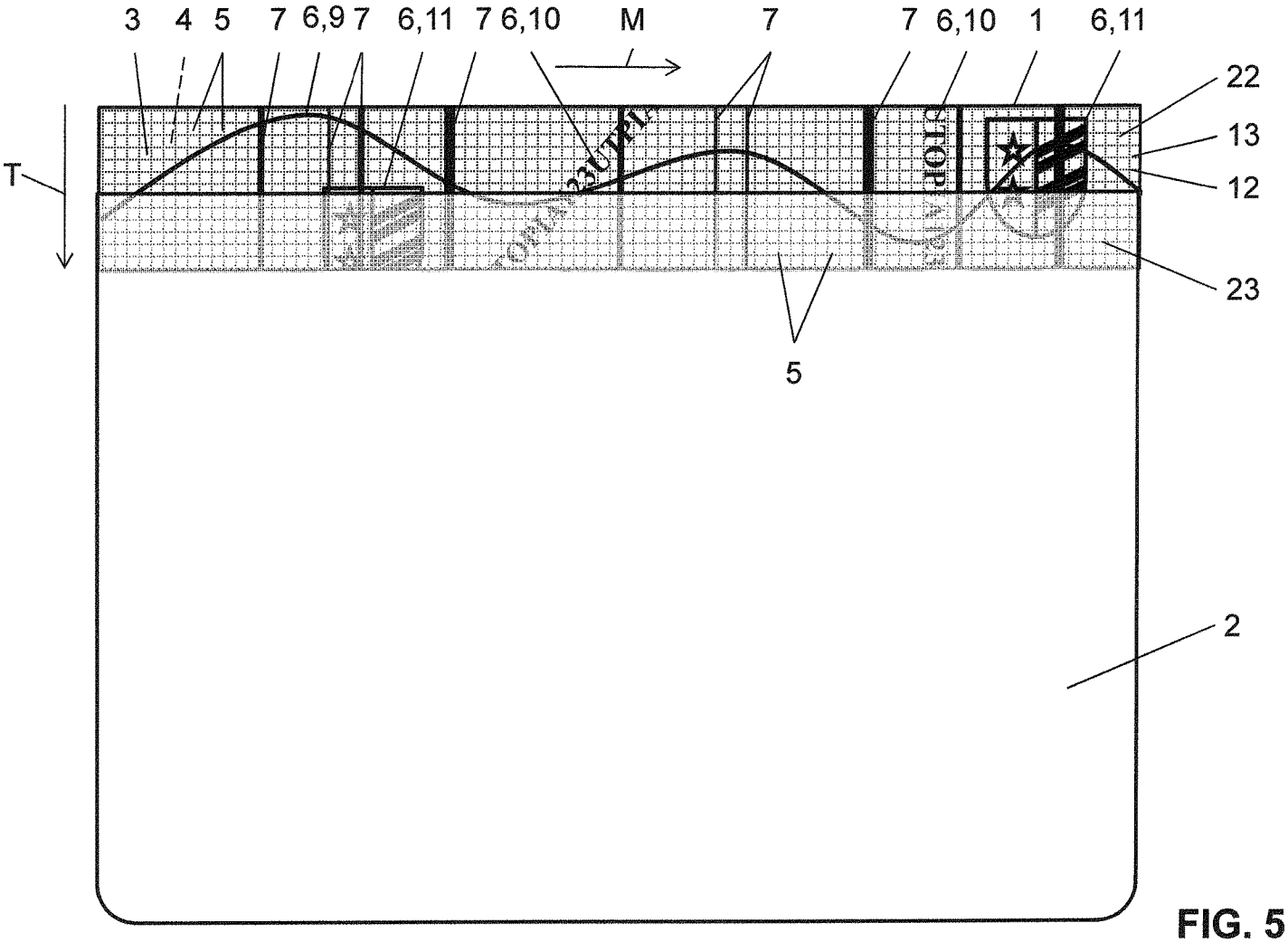
FIG. 5 a data page with a flexible band according to one of the previous figures.

In FIG. 5 a data page arrangement comprising a flexible band 1 according to one of the described embodiments and a data page 2 is shown. The flexible band 1 and the data page 2 are in a firm and non-detachable connection with each other. Said flexible band 1 protrudes with a protruding region 22 from the data page 2 and with a connection region 23 into the data page 2, in which connection region 23 the flexible band 1 is in a substantially non-detachably manner connected to the data page 2. In one possible variant said flexible band 2 forms one inner layer that extends at least partly between two layers of the data page, such that the flexible band is bound into the data page 2 by means of lamination, wherein at the apertures 5 of the flexible band 1 connection points are formed, which connect the flexible band 1 substantially non-detachably to the data page 2.

Inside the data page 2 it is possible to arrange a chip and an antenna. Typically the data page 2 is provided with personal information regarding to holder of the document.

LIST OF REFERENCE SIGNS

1 flexible band
2 data page
3 upper side
4 lower side

5 apertures
6 print pattern
7 security thread
8 pictogram
9 guilloche lines
10 alphanumeric code
11 coat of arms
12 weft threads
13 warp threads
14 monofilament
15 single filament
16 multifilament
17 single filament
18 group of neighboring security threads
19 first group
20 second group
21 third group
22 protruding region
23 connection region
M main direction

The invention claimed is:

1. A flexible band configured to be connected to a data page and to a booklet, wherein the flexible band extends along a main direction and comprises an upper side, a lower side, and a plurality of apertures, wherein the flexible band comprises at least one security element, wherein said at least one security element includes at least one security thread, or at least one security print pattern and the at least one security thread, wherein the flexible band comprises a textile band having weft threads and warp threads, and wherein said plurality of apertures are located between said weft threads and said warp threads, and wherein said at least one security thread replaces at least one of the following: at least one of said weft threads and at least one of said warp threads.

2. The flexible band according to claim 1, wherein said at least one security element includes said at least one security print pattern, wherein the at least one security print pattern includes at least one print color that is printed on at least one of the upper side and the lower side.

3. The flexible band according to claim 2, wherein said at least one print color extends at least partly into the flexible band as seen from at least one of said upper side and said lower side.

4. The flexible band according to claim 2, wherein the at least one print color includes at least one of a specific visual appearance, a specific fluorescence behavior, a specific absorbance behavior, or any combination thereof.

5. The flexible band according to claim 4, wherein the specific visual appearance of the at least one print color under normal ambient illumination is different from the specific visual appearance of the at least one print color under illumination in the ultraviolet region.

6. The flexible band according to claim 4, wherein the specific fluorescence behavior includes excitation with wave lengths in an ultraviolet domain.

7. The flexible band according to claim 4, wherein the specific absorbance behavior includes absorbance of wave lengths in an infrared domain.

8. The flexible band according to claim 1, wherein said at least one security element includes said at least one security print pattern, wherein a shape of the at least one security print pattern includes at least one of: drawings, pictograms, illustrations, guilloche lines, alphanumeric codes, emblems, coat of arms, personalized information, or any combination thereof.

9. The flexible band according to claim 1, wherein a visual appearance of said at least one security thread under normal ambient illumination is different from the visual appearance under illumination in an ultraviolet region.

10. The flexible band according to claim 1, wherein the same specific fluorescence behavior and the different specific fluorescence behaviors include excitation with wave lengths in an ultraviolet domain.

11. The flexible band according to claim 1, wherein the same specific absorbance behavior and the different specific absorbance behaviors include absorbance of wave lengths in an infrared domain.

12. The flexible band according to claim 1, wherein a diameter of said at least one security thread is the same as a diameter of said weft threads or said warp threads.

13. The flexible band according to claim 1, wherein said at least one security element comprises said at least one security thread, wherein at least two of said at least one security thread are arranged adjacent and parallel to each other and form a first group of neighboring security threads, said at least two security threads have at least one of a same specific visual appearance, a same specific fluorescence behavior, a same specific absorbance behavior, or any combination thereof, wherein an additional group of adjacent security threads or a single security thread is arranged at a distance from said first group of neighboring security threads.

14. The flexible band according to claim 1, comprising a first group including a first number of the at least one security thread, and a second group including a second number of the at least one security thread arranged a distance from the first group, wherein the first number of the at least one security thread within said first group are arranged adjacent to each other, and wherein the second number of the at least one security thread within said second group are arranged adjacent to each other.

15. The flexible band according to claim 14, wherein at least one additional group of security threads is arranged at a distance to said first group and said second group, said at least one additional group comprising the same number of security threads as the same number of security threads as one of the previous groups plus at least one additional security thread at least one of the first group and the second group.

16. The flexible band according to claim 1, wherein the at least one security element includes the at least one security print pattern and the at least one security thread, wherein said at least one security print pattern overlaps said at least one security thread.

17. The flexible band according to claim 1, wherein the at least one security print pattern includes a plurality of security print patterns are arranged at a spacing with regard to each other;

or wherein the at least one security thread includes a plurality of security threads are arranged at a spacing with regard to each other;

or wherein the at least one security print pattern includes a plurality of security print patterns and the at least one security thread includes a plurality of security threads, wherein said plurality of security print patterns are spaced with regard to each other, and wherein said plurality of security threads are spaced with regard to each other.

18. The flexible band according to claim 1, wherein said at least one security element is at least one of oriented perpendicular to the main direction of the flexible band, angularly tilted to the main direction of the flexible band, in line with the main direction of the flexible band, or any combination thereof.

19. The flexible band according to claim 1, wherein the flexible band comprises plastics from a group of polycondensations plastics or from a group of polymerization plastics.

20. A data page arrangement comprising the flexible band of claim 1 and a data page, wherein said flexible band protrudes with a protruding region from the data page and with a connection region into the data page, wherein in the connection region the flexible band is substantially non-detachably connected to the data page, wherein said flexible band forms an inner layer, such that the flexible band is bound into the data page by lamination, wherein at the apertures of the flexible band connection points are formed, wherein the connection points connect the flexible band substantially non-detachably to the data page.

21. The data page arrangement according to claim 20, wherein the at least one security element extends from the protruding region into the connection region and vice-versa.

22. The flexible band according to claim 5, wherein said specific visual appearance is at least one of transparent, white, red, blue, green, yellow, or any combination thereof under normal ambient illumination and is different under illumination in an ultraviolet region.

23. The flexible band according to claim 8, wherein the shape of the security print pattern includes emblems, wherein at least one of the emblems is a national emblem, and wherein the personalized information is a name, a photograph, a serial number, or any combination thereof.

24. The flexible band according to claim 9, wherein said visual appearance is transparent, white, red, blue, green, yellow, or any combination thereof under normal ambient illumination and is different under illumination in an ultraviolet region.

25. The flexible band according to claim 19, wherein the group of polycondensations plastics includes polyesters, and wherein the group of polymerisation plastics includes polyacrylnitriles, polytetrafluorethylene, polyethylene, polypropylene, polyvinylchloride, or any combination thereof.

26. The flexible band according to claim 25, wherein the polyesters include polyethylene terephtalate, polyamides, polyimides, aramides, polyamidimides, polycarbonates, or any combination thereof.

27. The flexible band according to claim 1, wherein a diameter of said at least one security thread is different than a diameter of said weft threads or said warp threads.

28. The flexible band according to claim 14, wherein a third group including a third number of the at least one security thread is arranged at a distance from the first group and at a distance from the second group.

29. The flexible band according to claim 14, wherein the first group includes a same number of the at least one security thread as the second group.

30. The flexible band according to claim 14, wherein the first group includes a different number of the at least one security thread as the second group.

31. The flexible band according to claim 1, wherein said at least one security thread is a monofilament having one single filament, wherein said one single filament has at least one of one single specific visual appearance, one single specific fluorescence behavior, one single specific absorbance behavior, or any combinations thereof; or wherein said one single filament has at least one of different specific visual appearances, different specific fluorescence behaviors, different specific absorbance behaviors, or any combination thereof, and wherein at least one of said different specific visual appearances, different specific fluorescence behaviors, different specific absorbance behaviors, or any combination thereof, changes regularly or irregularly spaced along an extension direction of the single filament.

32. The flexible band according to claim 1, wherein said at least one security thread is a multifilament with at least two single filaments that are twisted against each other or interwoven with each other, wherein the at least two single filaments have at least one of a same specific visual appearance, a same specific fluorescence behavior, a same specific absorbance behavior, or any combination thereof; or wherein the at least two single filaments have at least one of different specific visual appearances, different specific fluorescence behaviors, different specific absorbance behaviors, or any combination thereof, wherein at least one of said different visual appearances, different specific fluorescence behaviors, different specific absorbance behaviors, or any combination thereof, are the same along an extension direction of the at least two single filaments, or wherein at least one of said different specific visual appearances, different specific fluorescence behaviors, different specific absorbance behaviors, or any combination thereof, change regularly or irregularly spaced along the extension direction of the at least two single filaments.

* * * * *